United States Patent [19]

Wittes et al.

[11] 4,213,669

[45] Jul. 22, 1980

[54] TERMINAL COLLAR

[75] Inventors: James M. Wittes, Linden, N.J.; Julius F. Tibolla, Yardley, Pa.

[73] Assignee: GTE Sylvania Wiring Devices Incorporated, Trenton, N.J.

[21] Appl. No.: 941,534

[22] Filed: Sep. 11, 1978

[51] Int. Cl.[3] ..... H01R 11/10

[52] U.S. Cl. ..... 339/272 UC

[58] Field of Search ..... 339/253, 272 R, 272 A, 339/272 UC, 272

[56] References Cited

U.S. PATENT DOCUMENTS

| | | | |
|---|---|---|---|
| 2,117,112 | 5/1938 | Buchanan | 339/272 UC |
| 2,161,249 | 6/1939 | Dibner | 339/272 UC |
| 2,809,363 | 10/1957 | Schertel et al. | 339/272 |
| 2,907,978 | 10/1959 | Bergan | 339/272 |
| 2,953,771 | 9/1960 | Kussy | 339/272 |
| 3,253,251 | 5/1966 | Norden | 339/198 |
| 3,539,977 | 11/1970 | Woertz | 339/272 A |
| 3,775,733 | 11/1973 | Ege | 339/272 R |
| 3,836,941 | 9/1974 | Izraeli | 339/272 R |

FOREIGN PATENT DOCUMENTS

| | | | |
|---|---|---|---|
| 218745 | 4/1942 | Switzerland | 339/272 UC |
| 233001 | 6/1944 | Switzerland | 339/272 UC |
| 245508 | 8/1947 | Switzerland | 339/272 UC |
| 338224 | 6/1959 | Switzerland | 339/272 UC |
| 1268162 | 3/1972 | United Kingdom | 339/272 R |

OTHER PUBLICATIONS

Connectron, Inc., pp. 2-3, Catalog (undated).

*Primary Examiner*—Joseph H. McGlynn
*Attorney, Agent, or Firm*—Frederick A. Zoda; John J. Kane; Albert Sperry

[57] ABSTRACT

A terminal collar for electrically connecting a contact element includes a yoke of strip metal in the shape of a closed loop. End portions of the strip overlap, one being formed with a clearance opening and the other having a swaged boss engaging in the opening to prevent relative lateral deviation of the end portions. Side walls of the yoke define reentrant angles. Upon advancement of a screw through threads formed in the boss the contact element and conductor are clamped within the yoke. The side walls are stressed resiliently, and accommodate themselves to contraction or expansion of the wire, while at all times remaining within their elastic limits.

1 Claim, 10 Drawing Figures

TERMINAL COLLAR

BACKGROUND OF THE INVENTION

1. Field Of The Invention

The present invention relates to wiring devices in general, and more particularly to that type of device sometimes heretofore generally described as a solderless terminal, wherein a screw is advanced toward a seat for the purpose of exerting pressure effective to tightly clamp the stripped end of one or more conductor wires between a pressure plate constituted by the tang or connecting tab of a contact element and a seat provided in the terminal collar body or yoke. Such devices are usable to advantage in many types of wiring devices, as for example cord connectors of the type disclosed in co-pending application of James M. Wittes, Ser. No. 910,569 filed May 30, 1978. Terminal collars of the type disclosed herein are also usable to advantage in terminal blocks, bus bar assemblies, or indeed in any of a wide number of locations in which a conductor wire is to terminate and be electrically connected to a connection or terminal point.

2. Description Of The Prior Art

Terminal collars of the type disclosed are per se very well known. The most usual type is an integral, closed loop into which a screw is threaded, in which the loop is a slice of an elongated seamless tube. These have great strength and may be formed to a thickness sufficient to comply readily with UL standards as regards metal thickness and threads (UL Standard 498 as revised Mar. 24, 1978 provides that the metal shall be "at least 0.050 inch thick and shall have no fewer than 2 full threads in the metal for a terminal screw").

The disadvantage of such a terminal collar is, first of all, that it is expensive to make; and yet has the deficiency in that it does not maintain a tight clamping pressure on the wire conductor during the alternating cycles of heating and cooling of the wire, producing correspondingly alternating expansion and contraction cycles with resultant tendency toward loosening of the connection over a period of time.

A typical example of a terminal collar of the type disclosed above will be found in U.S. Pat. No. 3,775,733 (the modification shown in FIG. 6).

To overcome the deficiencies of terminal collars of the kind described immediately above, the prior art has developed terminal collars in which the clamping yokes are formed from simple, rectangular metal strips which may in and of themselves be of a thickness less than the prescribed UL Standard quoted above. In such instances, the strip metal blank is bent upon itself so that its end portions overlap, in the manner shown in FIG. 4 of the above-mentioned U.S. Pat. No. 3,775,733. In this type of device, the overlapping end portions are of a combined thickness that meets the UL Standard, and both end portions are tapped to provide the required number of threads. Such devices of this type, as heretofore made, nevertheless also have deficiencies in that force vectors exerted against the overlapping end portions during the clamping of a conductor in the yoke tend to misalign and damage the threads. Further, such devices as have heretofore been made, though designed for the purpose of maintaining clamping pressure during contraction and expansion cycles of the conductor, have nevertheless not been fully efficient in this regard. This is by reason of the fact that all of the clamping pressures are translated into the above-mentioned force vectors with the undesirable effect upon the threads noted. Or, separately or in addition to the tendency toward multilation of the threads, such devices have not heretofore been designed with sufficient elasticity to accommodate themselves to the contraction and expansion cycles of the wire conductor, except perhaps by transmission of all forces, that result from stressing of the metal, directly to the overlapping end portions of the metal strip without absorption or damping of said forces enroute to the threads formed in the overlapping end portions.

SUMMARY OF THE INVENTION

The present invention seeks to eliminate or at least reduce measurably the noted deficiencies in terminal collars of the formed blank type, through the provision of a rectangular metal strip which may be on the order of 0.030 inch thick, having at one end a swaged boss having a threaded opening, whereby to provide a metal thickness and a total number of threads that will meet the above-mentioned UL Standard. In the other end of the blank there is formed a clearance opening. When the blank is formed into a closed loop, the end portions overlap, and the boss enters the clearance opening. The boss is snugly engaged in the clearance opening, so that the boss and the edge of the clearance opening constitute an interlock or an interengaging means provided on the end portions, that will prevent relative separation thereof in a direction tending to open the closed loop resulting from their being brought into an overlapping relation. Provision of the threads only in one of the end portions eliminates the noted deficiency of possible misalignment of the threads formed in the openings of both end portions and mutilation of said threads during use resulting from the exertion of opposing forces thereagainst.

The side walls of the formed blank are pinched or bent inwardly, that is, they are formed with inwardly directed cambers or convexities through the provision of reentrant angles in the respective side walls. During use of the device, the side walls are stressed resiliently and yieldably, so as to cause the wire conductor to be effectively clamped against the associated tongue of a contact element. During alternate heating and cooling of the conductor, resulting in expansion and contraction cycles thereof, the tension of the side walls is automatically increased or decreased as the case may be, while at all times remaining within the elastic limits of the side walls. A tight clamping of the wire conductor, without necessity for requiring a retightening of all connections on a frequent and routine basis, thus results. The interlocking boss and clearance opening of the end portions of the blank, while themselves constituting an effective means for preventing opening of the closed loop even in the absence of resiliently stressable side walls, cooperate with the side walls in that the forces transmitted to the end portions responsive to stressing of the side walls are accepted and taken up by the interengaging swage and clearance opening without direction of any of said forces against the threaded connection between the screw and the yoke.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

The terminal collar constituting the present invention has been generally designated 10. It is usable in any of various types of wiring devices. It may be used, for example, in a male of female cord connector of the type illustrated in the above-mentioned co-pending patent application of James M. Wittes, Ser. No. 910,569. However, it of course has uses independently of such cord connectors. For example, it can be used in terminal blocks, transformers, or in any of a wide variety of other environments in which a solderless type of pressure terminal is desired to establish a connection point at the end of a wire conductor.

Figure 1:
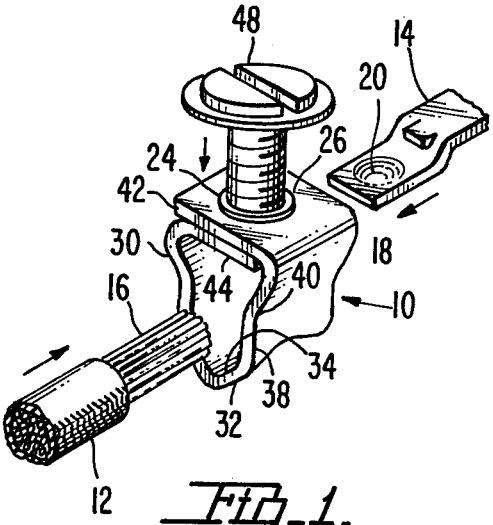
FIG. 1 is an exploded perspective view illustrating a terminal collar according to the present invention, a wire conductor and contact element being illustrated fragmentarily.
Figure 2:
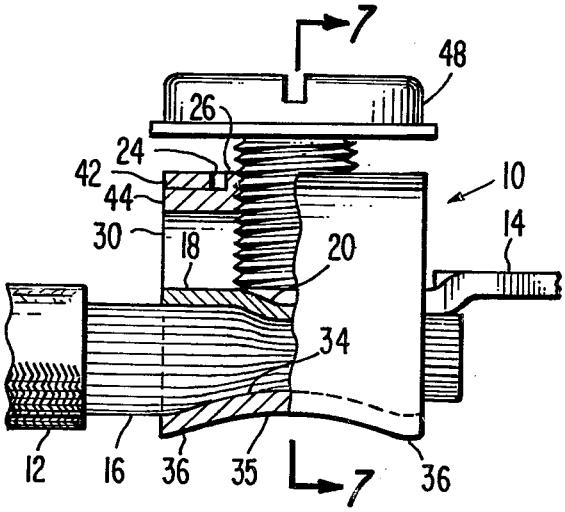
FIG. 2 is an enlarged view, partly in longitudinal section and partly in side elevation, of our terminal collar as it appears when in use in clamping relation to a wire conductor and contact element.

The wire conductor has been designated 12, and in FIG. 2 is shown tightly clamped in electrically conductive relation to a contact element 14 which might, for example, be a male or female contact of the kind used in the cord connector of the above-mentioned co-pending application of James M. Wittes. In the illustrated example, thus, the contact 14 is disposed in side-by-side relation to the strands 16 of the wire conductor within the yoke, the contact element being formed with a tang 18 having a shallow depression 20 the rim of which receives the clamping or pressure screw of the terminal collar.

Figure 3:
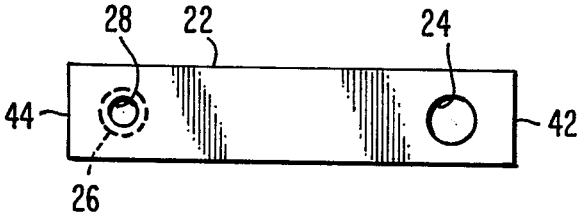
FIG. 3 is a plan view of the blank used in forming the yoke of the terminal collar.

The collar, in a preferred example, is formed from a flat metal blank 22 illustrated in FIG. 3, and in a commercial embodiment would preferably be of a material such as stainless steel or copper alloy rolled to the specified width and thickness. The thickness might, for example, be on the order of 0.030 inch, although this is not critical to the invention so long as the material has the desired characteristics of resiliency, strength, and capability of being shaped by conventional forming dies or equivalent tools.

In any event, blank 22 at one end is formed with a smooth-walled clearance aperture 24. At its other end, the blank is formed with a swaged boss 26, which may extend beyond the face of the blank a distance of approximately 0.030 inch in the illustrated example, whereby the boss has a total thickness equal to or exceeding the required UL standard of 0.050 inch. The boss is formed with a center opening 28.

Figure 5:
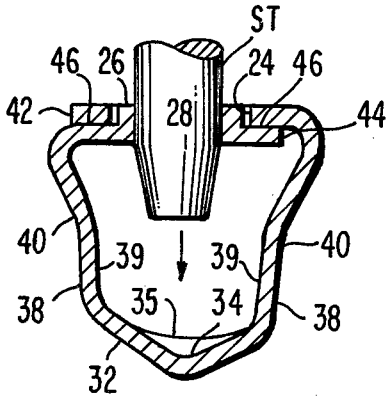
FIG. 5 is a view on the same scale as FIG. 2 illustrating the yoke in cross section in its finally formed state receiving a fragmentarily shown sizing tool for expanding the boss into a snugly fitted relationship within the associated clearance aperture.
Figure 4:
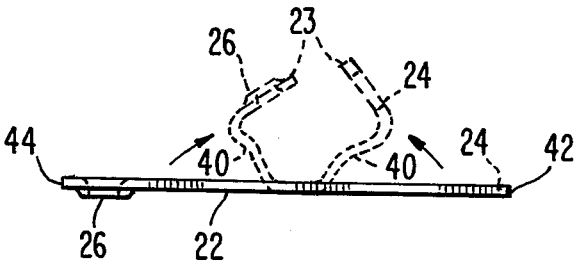
FIG. 4 is an edge view of said blank, the dotted lines illustrating the blank in its partially formed condition.
Figure 6:
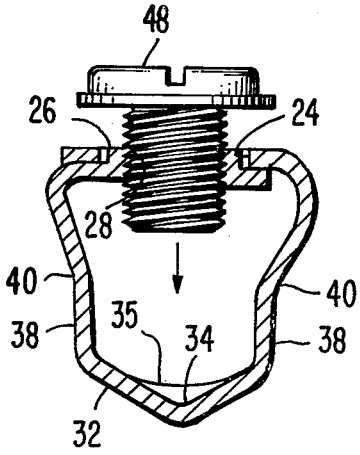
FIG. 6 is a view like FIG. 5 in which the sized boss has been threaded and has received the clamping screw.

The blank is formed into a closed yoke or loop 30 and in FIG. 4 is shown in dotted outline at an intermediate stage of its formation into the closed loop illustrated in FIG. 5. The end portions of the blank are brought into an overlapping, face-to-face relation as shown in FIG. 5, the swage entering the clearance aperture 24. At this stage of the manufacture, the clearance aperture may be of a size in relation to the outer diameter of the boss sufficient to readily permit the boss to enter the aperture and fit loosely therein.

FIG. 5 illustrates the next step of the manufacturing operation, wherein a sizing tool ST is extended through the opening 28 prior to tapping of the opening, in such fashion as to increase the size of the opening and force the outer surface of the boss into a snug fit within the clearance aperture 24.

Thereafter, opening 28 is threaded, providing the required number of threads to meet UL standards.

In its final form, the closed yoke or loop is held against opening or spreading by reason of the interlock represented by the extension of the boss directly into the clearance aperture, through the full thickness of the end portion of the blank in which the clearance aperture 24 is formed. Heretofore, in formed metal blanks used for the same purpose, the industry has resorted to separate locking devices, such as locking tabs extending into openings, or bent over into engagement with the adjacent part of the blank, these being relatively expensive manufacturing procedures which the present invention seeks to obviate.

In its final form, the yoke is shaped to include a shallowly V-shaped end wall 32, having a correspondingly shaped cradle or seat 34 for the clamped strands 16 of the conductor 12. Referring to FIG. 2, medially between the ends of the terminal collar, the seat is deformed upwardly to present an inwardly convex surface to the wire, thus to produce maximum clamping pressure in line with the longitudinal axis of the clamping screw. This arrangement is shown to particular advantage at 35 in FIG. 2, wherein it is seen that the inward convexity of seat 34 results in downwardly flared ends 36 of the yoke that facilitate the initial insertion of the wire conductor and the tang 18 of the contact element.

This saddle shape serves the following purposes: first, it stiffens, considerably, the end wall to form a relatively inflexible anvil against which to clamp the conductor; second, it produces locally greater clamping pressure against the conductor to decrease contact resistance without severing fine conductor strands and also increased resistance to mechanical pull out of the conductor; and third, it provides a flared entrance to the collar for smooth insertion of the conductor, especially one in stranded form.

Figure 7:
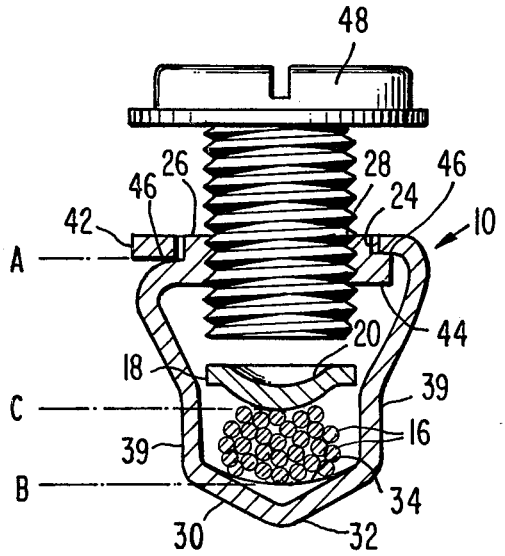
FIG. 7 is a transverse sectional view substantially on line 7—7 of FIG. 2, the screw being backed off preliminary to movement into its operative, clamping position.
Figure 8:
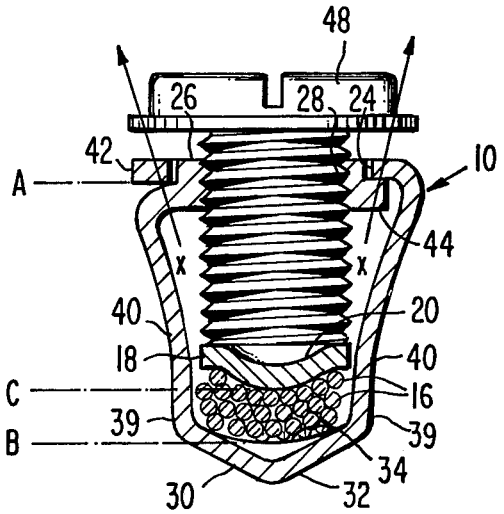
FIG. 8 is a view like FIG. 7 in which the screw is advanced into its operative, normal position.
Figure 9:
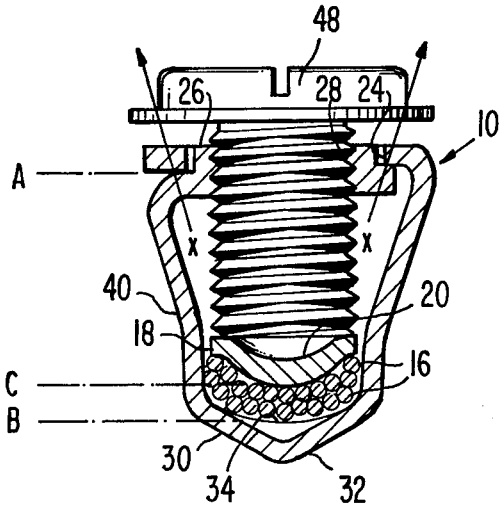
FIG. 9 is a view like FIG. 7 illustrating in somewhat exaggerated form the parts as they appear during a contraction cycle of the clamped conductor.

The yoke, in its final form, has side walls 38 which, adjacent the seat, have parallel, straight portions 39 spaced apart a distance to snugly, slidably receive and guide the tang 18 (see FIGS. 8 and 9). Viewing the yoke in cross section, in a direction toward the overlapping interlocked end portions thereof, it is seen from FIGS. 5–10 that above the straight portions 39 the yoke has portions that diverge in a direction toward the overlapping ends, as a result of which re-entrant angles 40 (FIG. 5) are defined in the side walls. Alternatively, it may be considered that the side walls are cambered or are inwardly convex in a direction inwardly of the yoke or closed loop.

The ends of the blank from which the yoke is formed have been designated 42, 44, and in the finally assembled form of the yoke it may be observed that they lie in face-to-face relation, with the end portion 44 having a shoulder 46 extending about the boss 26 formed thereon, the shoulder engaging end portion 42 and binding tightly thereagainst upon stressing of the side walls of the yoke.

The clamping screw has been designated 48, and after being threaded through opening 28 is preferably staked so as to prevent its accidental loss. The inner end of the screw forces the tang against the strands 16 in the manner shown in FIGS. 7 and 8. As a result, the strands are clamped and effectively confined within the space defined between seat or cradle 34 and the tang, which constitutes a pressure plate in these circumstances.

Figure 10:
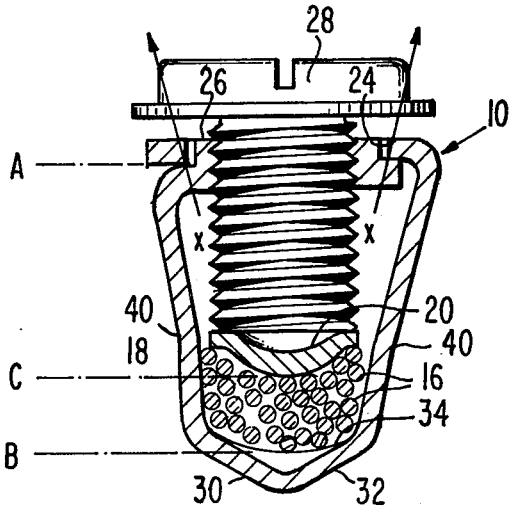
FIG. 10 is a view like FIG. 7 in which the parts are illustrated, again being exaggerated for the purpose of promoting understanding, as they appear during an expansion cycle of the clamped conductor.

Referring to FIG. 7, it may be considered that if 32 is one end wall and the overlapping end portions 42, 44 constitute the opposed end wall of the yoke, the distance between the end walls can be expressed in terms of the distance between planes A and B coincident respectively with shoulder 46 and seat 34. The force exerted downwardly against the lower end of the yoke, viewing the same as in FIGS. 8–10, is so exerted in the plane of the seat. The force exerted upwardly is exerted by shoulder 46 in plane A, at the interface between end portions 42, 44.

The plane C, viewing the same as in FIGS. 8–10, is the plane at which the downward pressure exerted responsive to advancement of the screw, is transmitted to the conductor.

In use, the parts appear as in FIG. 7 with the side walls of the yoke in an unstressed condition, and the screw retracted out of engagement with the tang 18. In these circumstances, the tang and the stripped end of the conductor are inserted into the yoke. Thereafter, the screw is advanced as in FIG. 8 so that there is relative movement of the pressure plate or tang 18 and the yoke. It will be understood, in this regard, that in some instances the contact element 18 is embedded or otherwise fixed in position, and as a result the entire yoke moves bodily (upwardly as viewed in FIG. 8) while the contact element remains in a stationary position.

In any event, the distance B–C is in effect reduced responsive to advancement of the screw, to clamp the wire against the seat 34, in tight engagement with the tang 18, thus to provide for maximum electrical conductivity at the connection between the conductor and the contact element. Further advancement or tightening of the screw now stresses the side walls as shown in FIG. 8, so that the re-entrant angles 40 become shallower and the distance A–B, that is, the distance between planes A and B as viewed in FIGS. 7 and 8, is increased.

This stresses the side walls, though not beyond the elastic limits thereof. Force is thus transmitted to the overlapping end portions 42, 44. The force so transmitted has been designated by upwardly divergent arrows X in FIGS. 8–10, passing through the overlapping end portions at opposite sides of the screw 48. These represent the force vectors applied to the overlapping end portions. Such vectors tend to spread the overlapping end portions, but any tendency on the part of said end portions to move out of their intimately interengaged or interlocked relationship is prevented by reason of the engagement of the boss 26 in the clearance aperture 24. As a result, the loop remains fully closed while being stretched in the manner shown in FIG. 8.

FIG. 8 represents a normal or intermediate effective clamping action as regards the strands of the wire conductor.

In FIG. 9, the parts are illustrated as they appear when, for example, the strands, which may in a typical case be of copper, contract distinctly following a shutting off of the current flowing therethrough. It will be understood in this regard, that when current is flowing through the connection, heat is developed, tending to expand the strands. When the current is not flowing through the connection, the strands tend to contract, so that the distance AB is reduced below the distance AB as seen in FIG. 8. However, the reduction is not great enough to cause the distance AB in FIG. 9 to be less than the distance AB as seen in FIG. 7 when the side walls are unstressed. In other words, when the wires contract to their minimum size, the side walls are still under tension, so that the contraction occurs within the elastic limits of the side walls. The side walls, accordingly, take up for the necessary wire contraction, so as to maintain a fully effective clamping engagement with the conductor under circumstances that would normally cause the conductor to work loose within the yoke.

FIG. 10 represents the relationship of the parts in an opposite condition, that is, when the current is flowing through the connection and heat is developed to the maximum degree expected. In these circumstances, the side walls are stressed to a further extent than they are under their normal conditions shown in FIG. 8. The reentrant angles 40 open to their maximum extent. Yet, however, it is important to note that the side walls, though stressed additionally responsive to expansion of the wire, are still within their elastic limits.

In all the conditions that occur following clamping of the conductor, that is, the normal, contracted, and expanded wire conditions shown in FIGS. 8–10, the side walls are under stress, within their elastic limits, and as a result, force vectors X are exerted. The interengagement of the boss and the clearance aperture thus remains effective in all these circumstances to interlock the overlapping end portions of the metal blank, and prevent spreading of the yoke. This interlock is caused to take place at locations outwardly from the threads, so that the threads under no circumstances tend to have any lateral force vectors or misalignment of the end portions, to an extent that would cause damage to the threads.

The construction eliminates the necessity of periodic retightening of the connection, such as is often required. At the same time, the device meets UL Standards as regards overall material thickness at the location of the threads, and also meets such standards as regards the number of threads needed. This is achieved with a formed metal blank the thickness of which is per se less than that which would normally be required to meet UL Standards.

It is thus seen that even in a yoke in which the side walls are, for example, parallel and do not permit resilient extension, the interlocking engagement of the end portions, achieved by the same means that provides the threads for the screw, eliminates the special locking tabs or similar expedients. And, said interlock when used in combination with resiliently extendable walls, has the further desirable effect of accepting force vectors resulting from placement of the walls under stress, without transmission of said forces through the threads in directions transversely of the threads or in directions having a transverse component as regards the threads.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. In a terminal collar of the type including a yoke, a screw threadedly engaged therein, and a pressure plate adapted to be advanced by the screw into clamping engagement with a conductor inserted in the yoke, the improvement comprising: an elongated strip of metal the end portions of which are brought into an overlapped relationship to shape said strip as a closed loop, one of the end portions having a threaded opening through which the screw may be advanced within the yoke and the other end portion having a smooth-walled clearance aperture in registration with the threaded opening and through which the screw extends into engagement with the threads of the opening, said yoke including a rigidly constituted seat for said conductor facing said screw and opposed resiliently extensible side walls at opposite sides of the seat, said side walls being stressed and placed under tension responsive to clamping of a conductor within a yoke, whereby to accommodate the yoke without loss of clamping force to contraction and expansion of the conductor while clamped within the yoke; and inter-engaging means on the overlapping end portions limiting the same, upon stressing of the side walls, against relative movement in directions tending to open said loop, said side walls when stressed remaining within their elastic limits in both the contracted and expanded states of the conductor, the side walls of the yoke being pre-formed, substantially midway between the seat and the overlapping end portions, with shallow reentrant angles which open in the stressed condition of the side walls and exert a contractile force on the side walls effective to maintain a tight clamping pressure on the conductor in both the contracted and expanded conditions thereof, said side walls having parallel, straight first portions adjacent the seat spaced apart a distance to snugly, slidably receive and guide said pressure plate toward the seat when the pressure plate is advanced by the screw, the side walls respectively having second portions into which the first portions merge and which extend in diverging paths in a direction away from the seat to cooperate with the first portions of the side walls in defining the respective reentrant angles, the second portions being continued along said diverging paths fully to the respective, overlapping end portions and merging directly into the overlapping end portions along curved bend lines located at the point of greatest divergence of the second portions of the side walls and generally coplanar with the respective overlapping end portions, said loop having a first end comprised of an intermediate portion of the strip and a second end that is formed by said overlapping end portions of the strip, the first end of the loop comprising said seat for the clamped conductor toward which the screw may be advanced for clamping the conductor against the seat, said side walls in their stressed condition being contracted to dispose the first and second ends of the loop at a predetermined minimum distance from each other, the side walls being stretched longitudinally in response to clamping of the conductor in the seat so as to increase the distance between the first and second ends of the loop, said distance being greater than the distance when the side walls are unstressed, both in the contracted and the expanded state of the conductor, said side walls when stretched remaining within their elastic limits both during contraction and expansion of the conductor, said seat being shaped to present an inward convexity to the conductor defining flared entrance and exit ways for the conductor and a relatively inflexible anvil therebetween against which the conductor is clamped.

* * * * *